US005176553A

United States Patent [19]

Tuttle

[11] Patent Number: 5,176,553

[45] Date of Patent: Jan. 5, 1993

[54] SAILBOARD FIN BOX ADAPTER

[76] Inventor: Lawrence J. Tuttle, P.O. Box 2790, Santa Cruz, Calif. 95063

[21] Appl. No.: 704,135

[22] Filed: May 22, 1991

[51] Int. Cl.[5] ..... B63B 1/00

[52] U.S. Cl. ..... 441/79; 441/74

[58] Field of Search ..... 441/74, 65, 79; 114/140, 39.2

[56] References Cited

U.S. PATENT DOCUMENTS 4,804,347 2/1989 Ross ..... 441/79

*Primary Examiner*—Edwin L. Swinehart

*Attorney, Agent, or Firm*—Jacques M. Dulin; Thomas C. Feix

[57] ABSTRACT

A fin box adapter for securing narrow based fins in cavity-type sailboard fin boxes comprising a generally trapezoidal block member having an outer surface configuration corresponding to an inner cavity surface configuration of a cavity fin box, and an inner slot-like cavity for receiving a bottom portion of a modified narrow fin base. In use, a narrow based fin is modified by trimming down any excessive length to fit the inner slot-like cavity and one or more press-fit cross-pins are used to secure the fin base within the inner slot-like cavity of the fin box adapter. A template is used to assist the installer in trimming down the fin base. The top surface of the fin box adapter is provided with one or more threaded holes which cooperate with the existing mounting hardware of the cavity fin box of the sailboard. In an alternate embodiment, a single threaded press-fitted cylindrical block is used in favor of the pins to secure the fin within the slot-like cavity. The block includes a threaded hole which is axially aligned with an existing corresponding hole provided in the center upper surface of the cavity fin box for receiving the mounting hardware used to secure a cavity-type fin within the fin box. Several other embodiments for the outer surface configuration of the fin box adapter are provided to permit use of a universal template cut down fin with different sized cavity boxes currently available.

19 Claims, 2 Drawing Sheets

SAILBOARD FIN BOX ADAPTER

FIELD

The invention relates generally to a method and apparatus for securing a fin or skeg to the bottom of a sailboard. More particularly, the invention relates to a method and apparatus for retro-fitting a conventional surfboard or sailboard fin of the type having a fin base thickness on the order of 9 mm into a "cavity" sailboard fin box, which typically have a fin base receivable opening in the range of 16 mm to 25 mm.

BACKGROUND

The sport of sailboarding or windsurfing has experienced a tremendous growth in popularity over the past several years. Along with this growth in popularity, there has also been numerous changes in equipment design through the use of, and experimentation with, lighter and stronger materials. Improved equipment permits the user to push the performance limits of the sailboard's ability to sail faster, jump over waves and carve sharper turns. It is also important to the individual sailor that these performance aspects be achieved at an affordable expense and that the equipment is durable so that it can withstand the repeated punishment that these increased performance demands place on the equipment on a regular basis.

It has also been long recognized that the fin and fin box region of the sailboard play a significant part in the sailboard's ability to perform in the water, since all the power of the wind harnessed by the sail must be transmitted through the fin in order to propel the sailboard along the water in the desired direction. Accordingly, there have been a number of attempts to solve the problems particular to sailboard fins and their fin boxes.

A primary problem common to both sailboard and surfboard fins is how to ensure a secure attachment to the underside of the board. A traditional approach is to permanently bond ("glass") the fin to the board with fiberglass and resin. This method has enjoyed an enduring popularity with the surfboard industry, since it provides a simple, light weight and secure fixture. Also, most surfboard shapers use more or less a standard fin design and thus few new surfboards come equipped with a fin box since there is little need to change fin sizes.

But surfboarding is not equivalent to sailboarding. A glassed-in fin is undesirable for use with a sailboard since it limits the interchange of different sized fins, which is of critical importance to a sailboarder. It is not uncommon for a sailboarder to have a quiver of five or six fins which are similar in profile but differ in size so they may be changed according to the wind conditions. Moreover, there are different fin designs intended for rough water, speed, wave riding, flat water recreational sailing, etc.

Channel-type fin boxes are typically shallow (U.S. standard is 25 mm deep and European standard is 33 mm deep) and have a narrow channel or slot width (9 mm being the U.S. and European standard channel width). A problem with these shallow/narrow fin boxes is that they are simply inadequate for windsurfing because of the great potential for the fin box to come loose and break out of the sailboard. If repairable, the repair is very expensive. This problem is due to the increased loads placed on the fin box due to the greater lifting forces associated with the generally larger surface area of the sailboard fins and the increased velocities of the sailboard fins relative to the water.

It is known from Lobe (U.S. Pat. No. 4,846,745) and Lobe (U.S. Pat. No. 4,964,826) to provide a slide plate member in an adjustable fin box which is predisposed to catastrophically fail when the fin is stressed to a limit which would normally cause the fin box to break out of the board, such as when the fin strikes a submerged rock. The slide plate member is normally disposed to be slidingly adjustable within the opposed parallel grooves provided in the inner longitudinal sides walls of the fin box. By permitting the slide plate member to fail first, the fin dangles loosely from the box so that the fin box does not tend to break out of the board. While this approach limits the damage to the most easily replaceable and least expensive component of the fin box system (i.e., the slide plate), the sailboard is left without any turning capability when the slide plate breaks. Also problems still exist with the fin box working itself loose from the board over time from the side stresses placed on the fin box.

Mizell (U.S. Pat. No. 4,379,703) discloses a fin box for use in surfboards wherein the fin box includes a laterally-extended perimeter flange member which interacts with the surrounding foam of the board to aid in the prevention of the fin box from coming loose from the board when the fin (when placed in the fin box) is stressed by a transverse load. The fin box also includes a fin base engagement means comprising a fixed nylon pin disposed in a forward end of the fin box and a steel insert/screw combination place at an angle at a rear end of the box. In use, a notch is provided in the forward end of a modified fin base and is adapted to receive the nylon pin while the rear end of the fin base is secured with the angled insert and screw. The fin box of Mizell, being relatively shallow and narrow in width, is not acceptable for extended use in sailboards since the transverse forces experienced by the fin and fin box of a fast moving sailboard are so much greater than the transverse forces experienced by a slower moving surfboard.

Sheerwood (U.S. Pat. No. 4,904,215) teaches to make a fin box retainer for holding the fin box to the rest of the board by surrounding a conventional plastic fin box made of ABS resin (acrylonitrile-butadiene-styrene copolymer) with a foamable liquid. The retainer is formed first within a mold and is then transferred from the mold and inserted into a prepared grove in the unfinished polyurethane foam board blank after which it is then glassed into place. The foam immediately surrounding the fin box, being approximately twice as dense as the rest of the foam blank, provides much more strength and rigidity for preventing the fin box from breaking out of the sailboard. Mizell does not discuss nor even address the problem of maintaining a firm and secure contact between the fin base and the fin box.

It is also known in the prior art to provide a stronger and more positive contact between the sailboard fin and the fin box by using a "cavity-type" fin box design. In contrast to a standard fin box (dimensions: $\frac{3}{8}$" slot width; $\frac{7}{8}$" slot depth; 7-8" slot length), the cavity-type box design typically has a wider slot width on the order of $\frac{5}{8}$" to 1 $\frac{1}{4}$" (16 mm to 25 mm), a variable slot depth in the range of 1 $\frac{1}{2}$" to 2" (38 mm to 50 mm), and a shorter slot length of about 6" (150 mm). With the appropriately dimensioned fin base, these new dimensions provide for a much stronger connection between the fin base and the cavity fin box and break out of the fin box is substantially reduced. Examples of currently commercially available cavity-type fin boxes include: the Tiga Conic Box and the F2 Power Box, both originating from Europe and distributed through FUNSPORT USA of Glendale, Calif.; and the Tuttle Box available through WATERAT SAILING EQUIPMENT of Santa Cruz, Calif.

Of course, the design of the cavity boxes have also required the design and manufacture of a specially designed fin (or "foil") which has a wider and deeper fin base configured to fit snugly within (or "plug in") the cavity. The fin and cavity box are often offered as a "fin system" to the purchaser whereby the specially made foils are sold in combination with sailboards having a cavity fin box.

One disadvantage with switching over to the cavity fin boxes is the increased economic costs involved, considering that the fins or foils for the cavity fin boxes cost about 30% more per fin than standard narrow based fins. At current retail prices, that translates to about a $30.00 difference per fin, since standard sailboard fins sell for about $70.00 retail and the improved foils sell for $100.00 or more. Thus, when a user upgrades his or her sailboard to a model that includes a cavity-type fin box, he will often be left with several useless, out-of-date narrow-based fins.

To get around this situation, some users have resorted to the labor-intensive approach of cutting down the excessive length of their standard narrow base fins and have used the cavity fin box as a mold to construct a permanent "enlarged" fin base to fit within the cavity fin box. Under this approach the user is locked in to using only that particular fin. Should the fin itself fail, a whole new fin and custom fin base must be made. Most fin manufacturers are also reluctant to start producing fins that will fit in the new cavity fin boxes since they are already set up for mass production of standard narrow based fins and expensive new tooling would necessarily be required to modify their standard fin designs to fit cavity fin boxes. Moreover, they would also have to tool up separately for each of the several different types of cavity fin box designs currently in use.

Thus, there is a definite need in the art for a low cost adapter which permits the retrofit use of a standard narrow base fin with a larger cavity-type fin box of a sailboard so that a user does not need to buy a complete new set of expensive fins specially made for a cavity-type fin box. There is also a need for such an adapter whereby the ordinary consumer with minimized technical know-how can perform by himself, any necessary modification to his standard narrow base fin. Further, there is a need for a fin adapter which retains the cavity-type fin box advantages over the prior art standard fin box of improved strength and performance and does not add an appreciable amount of weight to the fin system.

THE INVENTION

Objects

It is therefore a principal object of the invention to provide a fin adapter which permits the use of standard fins in cavity-type fin boxes;

It is another object of the invention to provide a fin adapter which provides a rigid engagement between the fin and fin box so that the torque induced by the flexing fin is effectively transferred through the fin box and the rest of the sailboard with no appreciable loss of energy;

It is another object of the invention to provide a fin adapter which can be used in combination with a variety of currently commercially available cavity-type fin boxes;

It is another object of the invention to provide a fin adapter which is of relatively low weight and can be produced for a low cost; and Still other objects will be evident from the following drawings, specification and claims.

DRAWINGS

The invention is illustrated in more detail by reference to the drawings in which.

SUMMARY

In accordance With a preferred embodiment of the invention, a sailboard fin box adapter is provided for securely retaining the bottom portion of a standard, narrow based fin which, in turn, is to be inserted and mounted within a cavity fin box for a sailboard. The fin box adapter is formed primarily of an injection molded thermoplastic, so that it is lightweight and can be made for relatively low cost. The adapter includes a cavity or slot for receiving the bottom portion of a narrow-based fin which has been trimmed or cut down to fit within the slot. A template for the inner cavity of the adapter is provided to assist in this installation.

One or more press fit pins are used to secure the base portion of the narrow-based fin within the slot-like inner cavity of the adapter, and may be removed to permit replacement with a different sized fin if desired. The outer surface of the adapter has depth, width and length dimensions sufficient to provide a close, glove-type fit when installed within a cavity fin box, and includes one or more bore holes provided on an end surface for receiving the existing mounting hardware associated with the sailboard and cavity fin box.

In a preferred embodiment two bore holes are provided and are threaded to cooperate with the existing mounting screws of a dual screw mountable cavity fin box.

In an alternate embodiment, a part of the mounting hardware between the cavity box and sailboard is used to secure the narrow based fin within the slot-like inner cavity of the adapter. In this alternate embodiment, a single cylindrical block is press fit through the sidewall adjacent the slot-like inner cavity of the adapter and a portion of the fin base, and includes a threaded hole which is aligned with the mounting screws of the fin box.

The outer surface configuration of the adapter may take the form of several different embodiments so that each different embodiment is dedicated for use with a particular cavity fin box design. The slot-like inner cavity for each embodiment is uniform to permit a single fin to be used with each fin box adapter embodiment.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
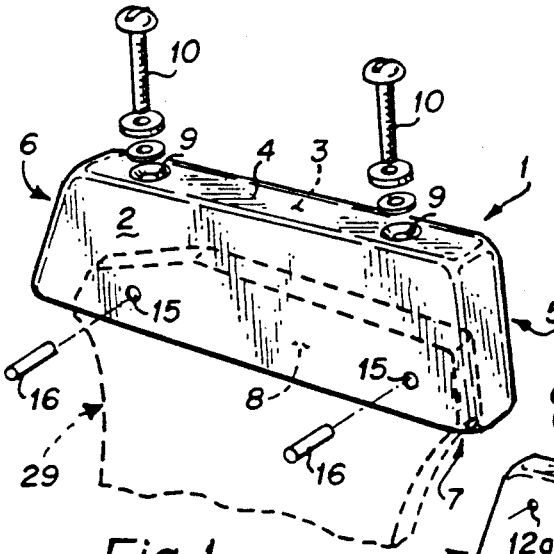
FIG. 1 is an isometric view of a preferred embodiment of a unitary fin box adapter of this invention.

A fin box adapter constructed in accordance with one embodiment of the present invention is indicated generally by the reference numeral 1 in FIG. 1. The fin box adapter 1 comprises a generally trapezoidal block defined by a pair of substantially parallel, opposed spaced side surfaces 2 and 3, a top surface 4, an open bottom end 7, a front end 5 and a rear end 6. In use, the front end 5 of the adapter 1 points to the nose or forward moving direction of the sailboard while the top surface 4 abuts against the bottom surface of a cavity-type fin box in the underside (water side) of a sailboard. The open bottom end 7 receives the base portion 8 of a standard narrow-based fin 29.

The top surface 4 is provided with threaded bore holes 9 for receiving screws 10 which are used to fix the adapter 1 and fin 29 to a sailboard. This will be discussed in greater detail below with reference to FIGS. 3-5.

The materials of construction for the adapter may include any rigid material that may be molded and/or machined to achieve the desired outer surface configuration and inner fin base receiving cavity for providing a secure and tight close-tolerance fit of a narrow based fin within the inner cavity surface 25 of a wide cavity-type fin box 24. In the preferred implementation of the invention, the adapter is constructed of a strong thermoplastic and is formed into the desired configuration through injection molding techniques that are well known in the art. FIGS. 1 and 3-5 show the adapter as a single solid piece formed by such an injection molding process.

Figure 2:
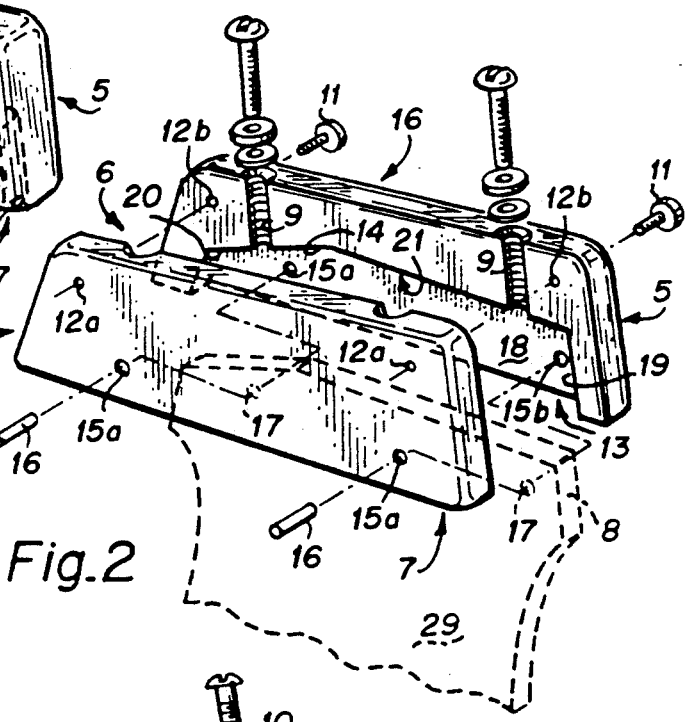
FIG. 2 is an exploded isometric view showing an alternate construction of the preferred embodiment of FIG. 1 and showing one way for securing a base portion of a fin (shown in phantom) to the adapter.

FIG. 2 shows an alternate configuration and method for manufacture of the adapter 1 whereby two halves 1*a*, 1*b* are first formed (preferably of an injection molded thermoplastic) and bonded together. As is seen in the drawing, the two halves 1*a*, 1*b* are held together by two small threaded screws 11 inserted within the corresponding threaded holes 12*a* and 12*b* of each adapter half 1*a* and 1*b*. While the means for holding the two halves 1*a*, 1*b* are shown as threaded screws, it is understood that any convenient means may be used, including but not limited to thermal bonding, glue, pins, nut and bolt combination, etc. Once the two adapter halves 1*a*, 1*b* are joined together, the threaded bore holes 9 may be prepared in the top surface as before with the FIG. 1 embodiment.

Figure 3:
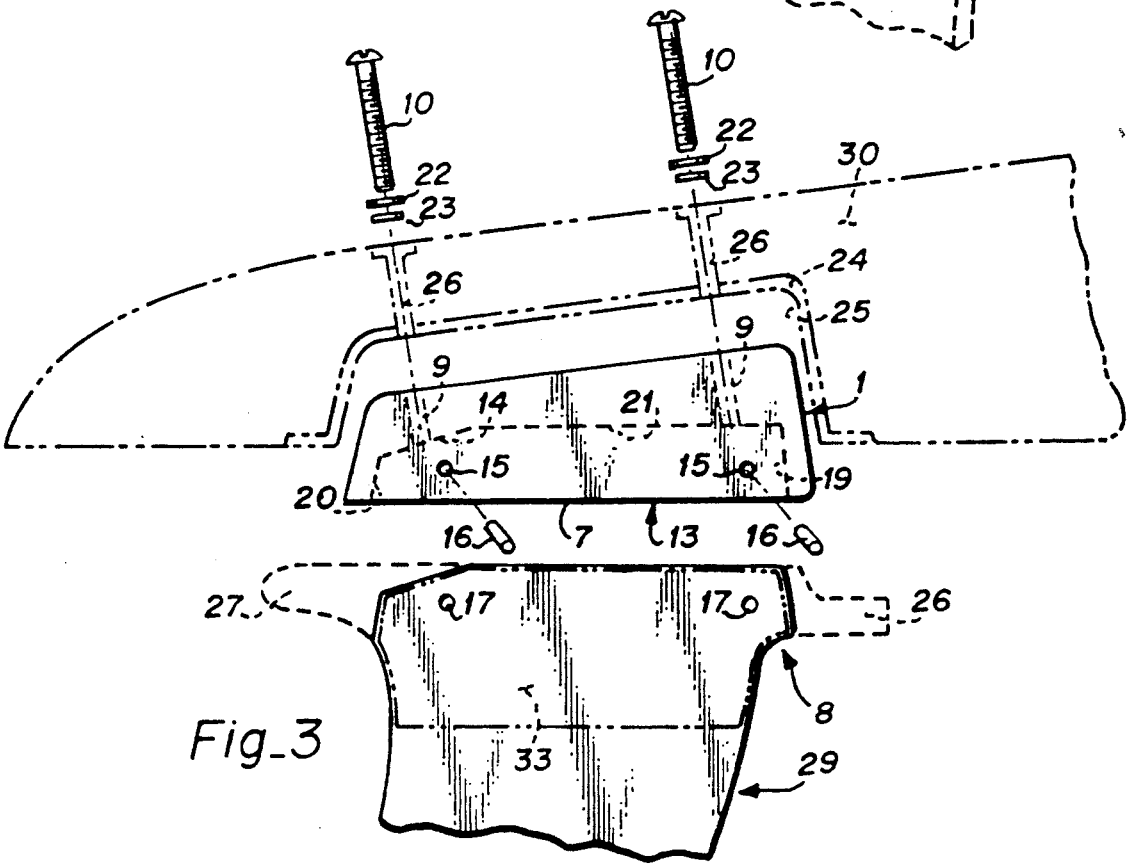
FIG. 3 is an exploded side elevation view of the preferred FIG. 1 embodiment of the fin box adapter showing a use position for securing a conventional narrow base fin (shown in phantom) to a cavity fin box of a sailboard (shown in phantom)
Figure 3A:
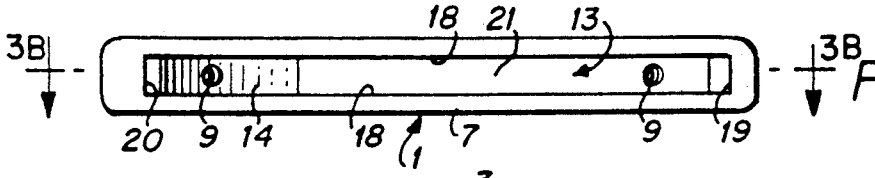
FIG. 3A is a bottom "looking in" plan view of the fin box adapter inner cavity.
Figure 3B:
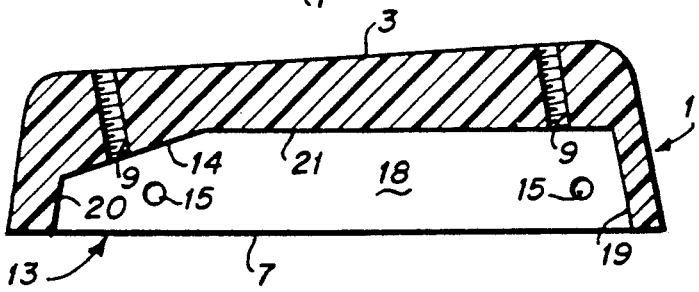
FIG. 3B is a side elevation view in a cross section of the fin box adapter taken along the line 3B—3B of FIG. 3A.

FIGS. 2, 3A and 3B show the detail of the inner cavity 13 which is formed into the bottom end 7 of the adapter 1 and is used for receiving the fin base 8. In the preferred embodiment, the inner cavity 13 resembles a substantially uniform slot comprising opposing vertical side walls 18, front end wall 19, rear end wall 20 and top wall 21. The inner cavity 13 has a depth and width sufficient to provide a tight fit of a narrow fin base. It has been found that a cavity having a depth of approximately 1" provides a sufficient inner cavity wall surface area for contacting the corresponding side walls of a standard fin base 8 to ensure a strong and stiff attachment of the fin 29. Under known molding and machining techniques, the tight tolerance of the slot width can be ensured to provide a frictional wedge fit within the cavity surface 25 of cavity fin box 24.

Figure 4:
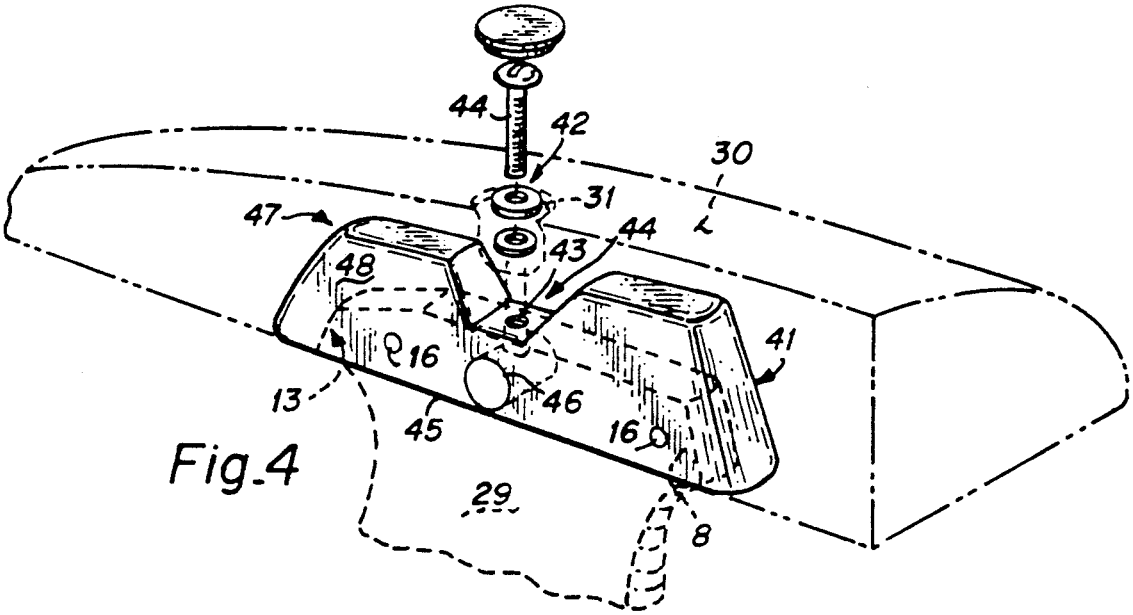
FIG. 4 is an isometric view of a first alternate embodiment of the fin box adapter.
Figure 5:
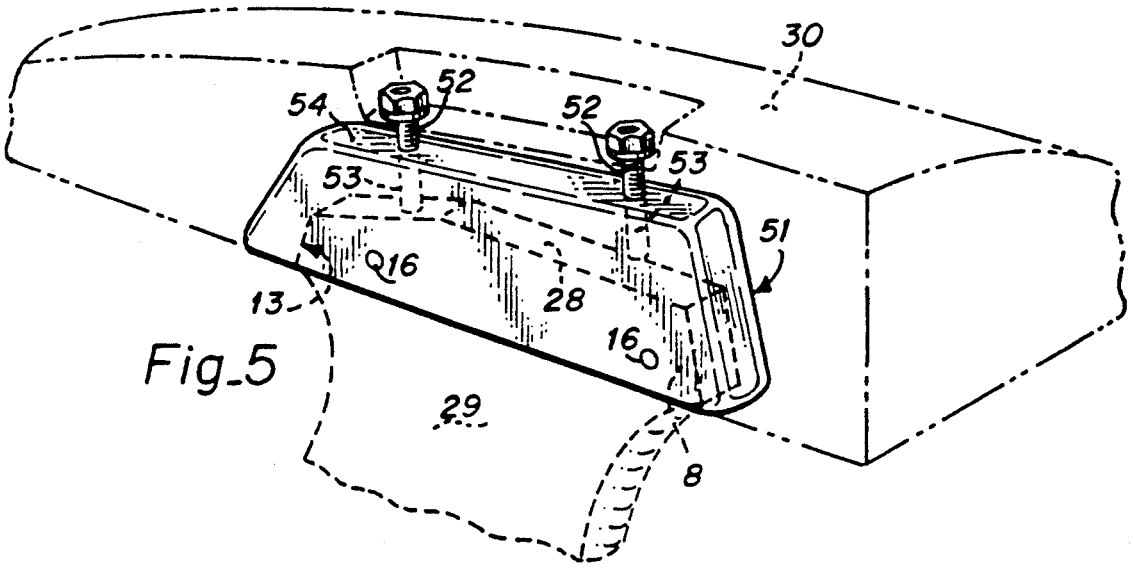
FIG. 5 is an isometric view of a second alternate embodiment of the fin box adapter.

In the embodiments of FIGS. 1-3B, the inner cavity 13 is also distinguished by an angled upper wall portion 14 in the corner area of the adapter adjacent the rear end 6 and top surface 4. The angled upper wall portion 14 results in more solid material in the adapter region of the inner cavity 13 so that threaded bore hole 9 will have a depth sufficient to provide a secure "bite" for screw 10. This design consideration will be appreciated in view of the fact that the vertical height of the adapter 1 gradually decreases from the front end 5 to the rear end 6. This height decrease (slant of surface 3) corresponds to the taper of a sailboard's thickness in its tail region 30 (see FIGS. 3, 4 and 5). For purposes of clarity the cavity fin boxes associated with the alternate embodiment of FIGS. 4 and 5 are omitted.

To retain the fin base 8 within the adapter inner cavity 13, a plurality of pins 16 are press fit through holes 15 provided in the side walls of the adapter 1 and through coaxially aligned holes 17 in the side walls of the fin base 8 (see FIG. 3). The use of press fit pins is especially advantageous for this application as it permits the fin to be easily and quickly replaced should it break or a different sized fin be desired in its place. Any play or looseness of the pins 16 within holes 15 and 17 due to repeated removal does not affect the secure fin attachment of the adapter 1, since the ends of the pins 16 are supported by the vertical side walls of the cavity fin box that the adapter 1 is being used in.

While the preferred embodiment discloses the use of two pins 16 spaced adjacent opposite ends of the adapter 1, it is understood that even a single pin, or 3 or more may be used with equal effectiveness. For best results in the case of a single press-fit cross pin, the pin should be used in the middle portion of the adapter 1. It is also understood that any other convenient means for removably securing the fin base within the adapter inner cavity 13 may be used, including screws with counter sunk heads, or like mounting hardware.

FIG. 3 illustrates a method for preparing a standard narrow based fin 29 for use with the adapter 1 of the invention. Standard narrow based fins typically have a fin base length of seven or more inches which must be trimmed down to fit within the length dimension of the inner cavity 13. Accordingly, portions of the fin base 8 must be cut off to meet this end. The dashed-line portions 26, 27 of the fin base 8 in FIG. 3 represent portions that were cut off so that the fin base 8 fits within the inner cavity 13. In use, a template 33 (shown in planton) for the inner cavity is provided to assist the installer in trimming down the fin base 8. It is understood that the template can be used to trim down the fin base over a wide range of fore/aft positions to provide the desired location of the fin with respect to the fin box.

FIG. 3 also shows in more detail how the adapter 1 is secured within fin box 24 of the sailboard tail region 30. The tailboard region 30 is already provided with the necessary holes 26 for receiving the mounting hardware (represented here as screws 10, steel washers 22, and rubber washer 23), which directly thread into corresponding holes provided in the end surface of a specially sized cavity box sailboard fin. The ease of implementing the adapter of this invention is readily evident in view of the fact that the adapter 1 replaces the wider and deeper fin base of the cavity box-type sailboard fin as can be seen from the drawings. Once the fin base 8 of the standard narrow base fin 29 has been trimmed and secured by pin(s) 16 within inner cavity 13 of adapter 1, the entire unit (adapter and fin) fits within the cavity fin box 24 in the same manner as the normal cavity-type sailboard fin. The trimmed surface 28 (FIGS. 3 and 5) may be bared and threaded coordinate with holes 26 so that extra long screws 10 can extend through adapter 1 to engage the fin 29.

A first alternate embodiment for the fin adapter 1 is indicated by reference numeral 41 of FIG. 4. The FIG. 4 embodiment is representative of one type of commercially available sailboard and fin box combinations, e.g., an F2 "powerbox" type. This type of cavity fin box is typically used in combination with production "epoxy" boards, which are made by an "inside out" process; that is, the sailboards are built up around the fin box within a mold. In contrast, the process for making a custom sailboard which includes a cavity box is done by an "outside in" process, that is, a foam blank is first shaped and a cavity fin box is prepared within a separate small foam block which is then mounted in a corresponding groove provided in the shaped foam blank. Then the entire custom board is glassed.

As is seen from FIG. 4, the top deck surface of the production board 30 is provided with a recess 31 for receiving the mounting hardware 42. The top portion 47 of fin box adapter 41 is configured to fit the cavity fin box 25 of the production board 30 and is provided with an axially aligned hole 43 for receiving the mounting hardware 42. Note in this embodiment the adapter 41 has a mid-rib notch to receivingly engage the cavity fin box transverse mid-rib (not shown). To prepare the fin adapter assembly for this embodiment, the base portion 8 of the fin 29 is received and fixed within inner cavity 13 by pins 16, as before. Then a cylindrical block 45, having a threaded hole 46 is press-fit into the middle portion of the fin box adapter side wall 48 such that threaded hole 46 is coaxially aligned with hole 43 to receive the threads of screw 44 so that the adapter may be firmly drawn tight and secured within the F2 cavity fin box. This embodiment combines the fin-securing means and the adapter securing means into a single means for fixing the fin and adapter to the sailboard.

FIG. 5 shows a second alternate embodiment for the fin box adapter 51 which is directed for use in combination with a wider and deeper cavity box also of the type currently used in combination with production sailboards. For the sake of brevity, the method for securing the fin base 8 within the inner cavity 13 is as before with the FIG. 3 embodiment, and the screws 52 normally provided to the board 30 cooperate with coaxially aligned threaded holes 53 provided in the top surface 54 of the fin box adapter 51. They may extend into the fin base if desired.

It should be noted that the inner cavity 13 of both fin box adapter embodiments of FIGS. 4 and 5 may optionally have the identical inner slot dimensions so that a fin which has been prepared for use with a fin box adapter of one type of production sailboard cavity fin box may be interchanged with a fin box adapter for any other type of production or custom board cavity fin box and vice versa. This "universal fin configuration" feature enhances the overall interchangeability and utility of the invention.

It should be understood that various modifications within the scope of this invention can be made by one of ordinary skill in the art without departing from the spirit thereof. For example, while the objects of the invention are directed to fins associated with sailboards, it should be noted that the invention may also be used in combination with other types of water craft, including but not limited to surfboards and light sailboats. I therefore wish my invention to be defined by the scope of the appended claims in view of the specification as broadly as the prior art will permit.

I claim:

1. A cavity fin box adapter for securing a demountable narrow base waterboard fin having a fin base insertable in and removable form a first waterboard fin box having a first slot width and depth dimension to a waterboard cavity fin box having a slot width and depth dimension wider and deeper than said first waterboard fin ox, said cavity fin box adapter comprising in operative combination:

a) a fin base receiving adapter member, said adapter member having a first outer surface and a second inner surface opening to said outer surface wherein:

i) said first outer surface defining a configuration to provide a comformingly tight fit when receivingly engaged within a corresponding fin base receiving cavity surface of said cavity fin box; and ii) said inner surface defining a slot having a width and depth dimension sufficient to provide a tight fit engagement with a base end portion of a narrow base fin;

b) means for retaining said base end portion of said narrow base fin within said slot; and c) means for fastening said adapter member within said cavity fin box.

2. A waterboard fin securing device as in claim 1 wherein:

a) said fin base retaining means is disposed adjacent said slot; and b) said fin base retaining means includes at least one press fit pin which is fitted through a coaxially aligned hole provided in opposing side wall portions of said first outer surface and in said fin base when said fin base is fully inserted within said slot.

3. A waterboard fin securing device as in claim 2 wherein:

a) said outer surface including opposed ends and sides, and at least one top surface; and b) said adapter fastening means includes at least one screw which cooperates with a corresponding threaded bore hole provided in said top surface portion of said adapter member to secure said adapter member to said cavity fin box and said waterboard when said outer surface of said adapter member is received within said cavity fin box.

4. A waterboard fin securing device as in claim 3 wherein:

a) said screw is a center mounting screw normally provided to said waterboard for securing a dedicated fin for said cavity fin box within said cavity fin box.

5. A waterboard fin securing device as in claim 3 wherein:

a) said fastening means includes two screws, and each of said screws is disposed within a hole associated with said waterboard cavity fin box; and b) each of said screws is receivingly engaged by a corresponding threaded hole provided in said top surface portion of said adapter member.

6. A waterboard fin securing device as in claim 5 wherein:

a) said pair of screws are the mounting screws normally provided to said waterboard for securing a dedicated fin for said cavity fin box within said cavity fin box.

7. A waterboard fin securing device as in claim 1 wherein said fin retaining means cooperates with said adapter fastening means to provide a source of secure attachment between said narrow base fin, said adapter member and said cavity fin box.

8. A waterboard fin securing device as in claim 7 wherein:

a) said fastening means includes at least one screw which is inserted through co-aligned holes provided in said waterboard and cavity fin box and is receivingly engaged by a co-aligned bore hole in a top surface portion of said adapter member;

b) said retaining means includes at least one transversely disposed press-fit pin for retaining said fin base within said slot; and c) said press-fit pin includes a threaded bore hole aligned with said bore hole of said adapter member to permit receiving engagement of said screw of said fastening means.

9. A waterboard fin securing device as in claim 8 wherein said screw is a mounting screw normally provided to said waterboard for securing a dedicated cavity box fin within said cavity fin box.

10. A method for securing a narrow base waterboard fin having a fin base configuration adapted for use with a first fin box having a first width and depth dimension within a cavity fin box having a width and depth dimension wider and deeper than said first fin box comprising the steps of:

a) providing an adapter member having an outer surface configuration and a slot wherein:

i) said outer surface configuration matches a corresponding cavity surface configuration for said cavity fin box; and ii) said slot is disposed in a water side surface of said adapter member for receiving a fin base of said narrow base fin;

b) trimming off excess portions of said fin base of said narrow base fin to permit said fin base to tightly fit within said adapter slot;

c) securing said fin base within said slot; and d) attaching said adapter member within said cavity fin box.

11. A method for securing a narrow base fin within a cavity box as in claim 10 wherein:

a) said step of securing said fin base within said slot includes providing at least one transverse bore hole through said adapter member and said fin base to permit the press fit of a pin for removable securement of said fin base within said slot.

12. A method for securing a narrow base fin within a cavity box as in claim 11 wherein:

a) said step of attaching said adapter member within said cavity fin box includes providing at least one bore hole disposed in an upper region of said adapter plug for receivingly engaging existing dedicated fin mounting hardware associated with said cavity fin box.

13. A kit for securing a narrow base waterboard fin adapted for use with a first fin box having a first width and depth dimension within a cavity fin box having a width and depth dimension wider and deeper than said first fin box, comprising:

a) and adapter member having an outer surface configuration and a slot wherein:

i) said outer surface configuration matches a corresponding cavity surface configuration for said cavity fin box; and ii) said slot is disposed in a water side surface of said adapter member for receiving a base portion of a fin base of a narrow base fin;

b) a template having a profile corresponding to the outline of an inner surface of said slot to convert a narrow base fin to a universal base shape; and c) means for securing said narrow base fin within said adapter slot.

14. A kit as in claim 13 wherein:

a) said adapter member has an extended surface configured to a dedicated cavity box.

15. A kit as in claim 14 wherein:

a) said adapter includes a recess to receivingly engage a cavity box transverse mid-rib.

16. A kit as in claim 13 wherein:

a) said adapter includes a plurality of threaded holes aligned to receive cavity box securing screws.

17. A kit as in claim 13 which includes:

a) screws for securing said adapter within said cavity box.

18. A kit as in claim 17 wherein:

a) said screws are long enough to pass through said board, said cavity box, said adapter and into threaded holes provided into the universal base of said narrow base fin.

19. A universal waterboard fin base adapter system for securing waterboard fins of a plurality of fin base configurations to an oversize fin box comprising in operative combination:

a) an adapter member having a first outer surface and a second inner surface opening to said outer surface wherein:

i) said first outer surface defining a configuration to provide a conformingly tight fit when receivingly engaged within a corresponding fin base receiving cavity of said oversize cavity fin box;

ii) said inner surface defining a slot having a width and depth dimension sufficient to provide a tight fit engagement with a base end portion of a first water board fin having a fin base outer surface configuration sized smaller than said cavity fin box receiving cavity;

b) means for retaining said base end portion of said first fin within said slot; and c) means for fastening said adapter member within said oversize cavity fin box.

* * * * *